US010633969B2

(12) United States Patent
Howard et al.

(10) Patent No.: US 10,633,969 B2
(45) Date of Patent: Apr. 28, 2020

(54) DYNAMIC IN-SITU MEASUREMENT OF RESERVOIR WETTABILITY

(71) Applicant: CONOCOPHILLIPS COMPANY, Houston, TX (US)

(72) Inventors: James J. Howard, Tulsa, OK (US); Siluni Wickramathilaka, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 47 days.

(21) Appl. No.: 14/337,438

(22) Filed: Jul. 22, 2014

(65) Prior Publication Data

US 2015/0034307 A1 Feb. 5, 2015

Related U.S. Application Data

(60) Provisional application No. 61/861,013, filed on Aug. 1, 2013.

(51) Int. Cl.
*E21B 49/00* (2006.01)

(52) U.S. Cl.
CPC ..... *E21B 49/008* (2013.01)

(58) Field of Classification Search
CPC ..... E21B 49/008
See application file for complete search history.

(56) References Cited

U.S. PATENT DOCUMENTS

| | | | | |
|---|---|---|---|---|
| 4,933,638 | A * | 6/1990 | Kleinberg | G01N 24/081 324/303 |
| 6,883,702 | B2 | 4/2005 | Hurlimann et al. | |
| 7,032,661 | B2 * | 4/2006 | Georgi | E21B 49/00 166/250.01 |
| 8,076,933 | B2 * | 12/2011 | Freedman | G01V 3/32 324/303 |
| 8,794,318 | B2 * | 8/2014 | Harrigan | E21B 49/008 166/100 |
| 2007/0039731 | A1 | 2/2007 | Fox et al. | |
| 2010/0264915 | A1 * | 10/2010 | Saldungaray | E21B 43/16 324/303 |
| 2012/0229135 | A1 | 9/2012 | Hurlimann et al. | |
| 2012/0241149 | A1 * | 9/2012 | Chen | G01V 3/32 166/250.01 |
| 2013/0057277 | A1 | 3/2013 | Zielinski et al. | |

OTHER PUBLICATIONS

Engler, Thomas W., Fluid Flow in Porous Media, Fall 2010, Petroleum Engineering 524, New Mexico Tech, p. 5.12-5.21.*

(Continued)

*Primary Examiner* — Angela M DiTrani Leff
(74) *Attorney, Agent, or Firm* — Boulware & Valoir

(57) ABSTRACT

One methods for in-situ characterization of a reservoir rock includes: (a) sealing an interval corresponding to a selected depth or depths within the subterranean formation; (b) injecting a displacement fluid into the interval, wherein the displacement fluid displaces a reservoir fluid stored in the reservoir rock; (c) monitoring movement of the displacement fluid or the reservoir fluid in the reservoir rock; and (d) assessing wettability of the reservoir rock based on (c) or determining recovery rate of the reservoir fluid.

20 Claims, 5 Drawing Sheets

(56) References Cited

OTHER PUBLICATIONS

Schembre et al., Wettability alteration and oil recovery by water imbibition at elevated temperatures, Jun. 2006, Journal of Petroleum Science and Engineering, vol. 52, Issues 1-4, pp. 131-148 (Year: 2006).*
International Search Report. PCT/US2014/047604. dated Nov. 20, 2014.
Ma et al. Characterization of Wettability From Spontaneous Imbibition Measurements. Journal of Canadian Petroleum Technology Special Edition 1999, vol. 38, No. 13, 94-97.
Wickramathilaka, Siluni, Dissertation, "Aspects of Oil Recovery by Spontaneous Imbibition and Wettability Alteration", University of Wyoming 2010.
Ai-Mahrooqi, S.H., et al., an investigation of the effect of wettability on NMR characteristics of sandstone rock and fluid systems, Journal of Petroleum Science & Engineering 3 (2003) 389-398.
Chen, J., et al., NMR wettability indices: Effect of OBM on wettability and NMR responses, Journal of Petroleum Science & Engineering 52 (2006) 161-171.
Freeman, R, et al., Wettability, Saturation, and Viscosity From NMR Measurements, Society of Petroleum Engineers; SPE 87340, Dec. 2003, 317-327.
Howard, J.J., Quantitative Estimates of Porous Media Wettability From Proton NMR Measurements, Magnetic Resonance Imaging, vol. 16, Nos. 5/6, 529-533, 1998.
Looyestijn, W.J., Wettability Index Determination from NMR Logs, Petrophysics, vol. 29, No. 2 (Apr. 2008); p. 130-145.

* cited by examiner

DYNAMIC IN-SITU MEASUREMENT OF RESERVOIR WETTABILITY

CROSS-REFERENCE TO RELATED APPLICATIONS

This application is a non-provisional application which claims benefit under 35 USC § 119(e) to U.S. Provisional Application Ser. No. 61/861,013 filed 1 Aug. 2013, entitled "DYNAMIC IN-SITU MEASUREMENT OF RESERVOIR WETTABILITY."

FIELD OF THE INVENTION

The present invention relates generally to enhanced recovery of fluids from a porous media. More particularly, but not by way of limitation, embodiments of the present invention include systems and methods for determining wettability of a hydrocarbon-producing reservoir by in-situ monitoring of fluid displacement.

BACKGROUND OF THE INVENTION

Reservoir wettability can affect reservoir's properties such as, but not limited to, relative permeability, capillary pressure, fluid location, fluid flow, and residual oil distribution. Accurately characterizing reservoir wettability can significantly impact oil production methods and strategy. For example, some Enhanced Oil Recovery (EOR) techniques focus on altering reservoir wettability as a way of recovering more oil. Reservoir wettability can also play an important role in determining whether certain Improved Oil Recovery (IOR) techniques will work in a given reservoir.

As used herein, the term "wettability" refers to the tendency of a particular fluid to spread on or adhere to a solid surface in the presence of another immiscible fluid. As used herein, the term "reservoir wettability" refers to the ability of a reservoir rock surface to preferentially contact a particular fluid.

Wettability of a reservoir rock can be determined by a number of methods using various analytical tools. One method of determining reservoir wettability includes measuring contact angle of an oil droplet on the reservoir rock. Other conventional methods involve measuring work required to do a forced fluid displacement, measuring adsorption of a dye in an aqueous solvent, and following changes in nuclear magnetic resonance (NMR) relaxation times. These wettability studies are typically limited to laboratory experiments involving core samples taken from the reservoir, which may not adequately account for spatial- and production-dependent variations in temperature, pressure, fluid chemistry among other reservoir properties that are found downhole. One of the methods used to characterize wettability of laboratory samples is to measure the rate of spontaneous imbibition of water into an oil-saturated core plug. Imbibition rates are determined from the total oil production from the sample over time. A dimensionless time, which corrects for variations in sample size, pore geometry and certain rock and fluid properties, can provide greater insights into the imbibition processes.

BRIEF SUMMARY OF THE DISCLOSURE

The present invention relates generally to enhanced recovery of fluids from a porous media. More particularly, but not by way of limitation, embodiments of the present invention include systems and methods for determining wettability of a hydrocarbon-producing reservoir by in-situ monitoring of fluid displacement.

One example of a method of characterizing a subterranean formation comprises: (a) sealing an interval corresponding to a selected depth or depths within the subterranean formation; (b) injecting a displacement fluid into the interval, wherein the displacement fluid displaces a reservoir fluid stored in the reservoir rock; (c) monitoring movement of the displacement fluid or the reservoir fluid in the reservoir rock; and (d) assessing wettability of the reservoir rock based on (c) or determining recovery rate of the reservoir fluid.

Another example of a method of characterizing a subterranean formation includes: (a) placing a reservoir wettability logging tool comprising a fluid injection tool and a fluid monitoring tool in the subterranean formation at a selected depth or position; (b) sealing an interval corresponding to the selected depth with one or more sealers; (c) injecting a displacement fluid into the interval at a selected flow rate via the fluid injection tool; (d) monitoring movement of the displacement fluid or displaced fluid via the fluid monitoring tool; and (e) assessing wettability of the reservoir rock based on (d) or determining recovery rate of the reservoir fluid.

Yet another example of a method of characterizing a subterranean formation includes: (a) placing a reservoir wettability logging tool comprising a fluid injection tool and a fluid monitoring tool in the subterranean formation at a selected depth; (b) sealing an interval corresponding to the selected depth with one or more sealers; (c) injecting a displacement fluid into the interval at a selected flow rate via the fluid injection tool; and (d) monitoring movement of the displacement fluid or displaced fluid via the fluid monitoring tool.

BRIEF DESCRIPTION OF THE DRAWINGS

A more complete understanding of the present invention and benefits thereof may be acquired by referring to the following description taken in conjunction with the accompanying drawings in which:

FIG. 4A shows a plot of oil recovery versus imbibition time in accordance with one or more embodiments. FIG. 4B shows a plot of oil recovery versus dimensionless time in accordance with one or more embodiments.

FIG. 5A shows a plot of oil recovery versus imbibition time in accordance with one or more embodiments. FIG. 5B shows a plot of oil recovery versus dimensionless time in accordance with one or more embodiments.

FIG. 6A shows a plot of oil recovery versus imbibition time in accordance with one or more embodiments. FIG. 6B shows a plot of oil recovery versus dimensionless time in accordance with one or more embodiments.

DETAILED DESCRIPTION

Figure 1:
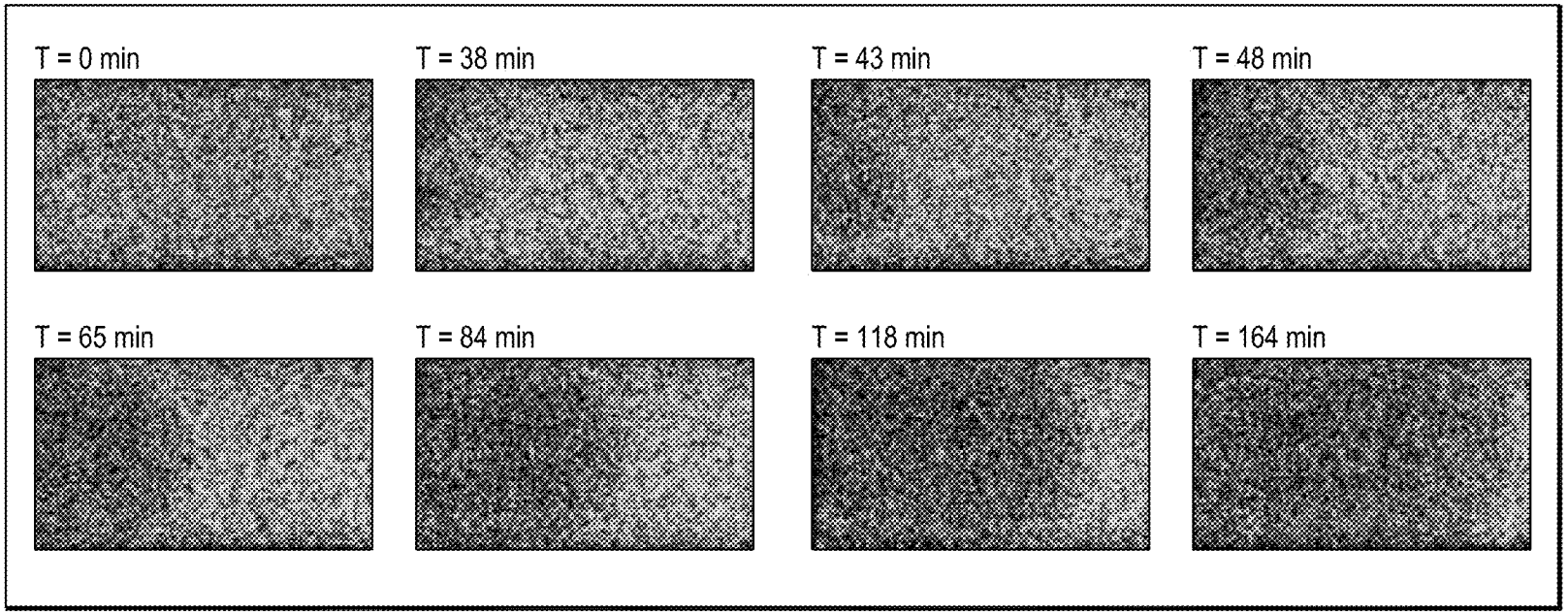
FIG. 1 shows a series of time-lapse MRI images of water (dark) displacing oil (light) in a core sample.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

The present invention provides tools and methods for characterizing a subterranean formation. Characterizations of the subterranean formation may include, for example, reservoir wettability, porosity, water and oil saturation, relative permeability of fluids, and the like. In particular, reservoir wettability is an important parameter that can play a crucial role in maximizing recovery of hydrocarbons. The present invention can determine reservoir wettability via in-situ monitoring of fluid front movement during spontaneous imbibition. By determining and understanding the reservoir wettability, better/more suitable hydrocarbon recovery processes could be implemented to improve oil recovery from reservoirs. Other advantages will be apparent from the disclosure herein.

As will be described later in more detail, various analytical tools may be employed in a well at reservoir depths to monitor fluid front movement, resulting in measurements that may be analyzed to determine wettability. These tools may include, but are not limited to, logging tools (e.g., nuclear magnetic resonance logging tools) and/or sensors (e.g., electrical array sensors) attached to a wellbore wall (cased or open hole). Other analytical tools that can qualitatively or quantitatively characterize fluid front movement may also be employed according to one or more embodiments of the present invention.

Some embodiments provide a method of characterizing a subterranean formation including: (a) sealing an interval corresponding to a selected depth or depths within the subterranean formation; (b) injecting a displacement fluid into the interval, wherein the displacement fluid displaces a reservoir fluid stored in the reservoir rock; (c) monitoring movement of the displacement fluid or the reservoir fluid in the reservoir rock; and (d) assessing wettability of the reservoir rock based on (c) or determining recovery rate of the reservoir fluid. In some embodiments, the sealing may be reversible, which allows subsequent characterizations of different intervals along the subterranean formation. The sealing may be achieved by sealers (e.g., packers) that are attached or coupled to a logging tool that can be placed downhole at any depth. The logging tool may also include a fluid injection tool and a fluid monitoring tool, which work in conjunction with the sealers to provide imbibition studies for a given interval. In other words, the logging tool may be positioned at various points along a wellbore to obtain spatial-dependent information. In other embodiments, the logging tool may be set at a selected depth while employing a fluid monitoring tool that can scan longitudinally along the wellbore.

Reservoir Wettability

Reservoir wettability can be determined by monitoring rate of imbibition, which is the rate at which a displacement fluid (e.g., water, brine, aqueous solution, produced water, etc.) displaces a reservoir fluid (e.g., oil, hydrocarbon, hydrocarbon gas, natural gas, etc.) in a reservoir. In some embodiments, the displacement fluid may include water, deuterated water ($D_2O$, DHO) water and one or more solutes, fluid mixtures that include water (e.g., aqueous fluids, mixtures of water and oil, etc.) and gas as an injectant fluid. Factors that can affect wettability include, but are not limited to, rock type, crude oil type, displacing fluid composition and salinity, initial water saturation, reservoir temperature, and the like. Rate of imbibition can be measured by tracking either the displacement fluid or the reservoir fluid in a reservoir. In some embodiments, imbibition measurements may include monitoring initiation of imbibition, frontal movement, and/or saturation profiles. Imbibition measurements can be tracked dynamically, over a relatively long time period. In-situ measurements can save time, allowing measurements to be made at various reservoir intervals, and providing measurements based on real-world conditions. Other advantages should be apparent from the disclosure herein.

As used herein, the term "imbibition" refers to the displacement of one fluid by another immiscible fluid. The term "water imbibition" refers to the displacement of a reservoir fluid (e.g., hydrocarbons) in a porous media (e.g., reservoir rock) by water. As used herein, the term "water" refers to water that can be pure or near-pure (e.g., greater than about 90% by weight).

In-situ reservoir wettability measurements can be made by performing a down-hole testing of imbibition rates. These measurements can be taken by a number of analytical tools. In some embodiments, the analytical tools may include, but are not limited to, NMR (can measure relaxation and diffusion), electrical resistivity tools (e.g., electrical array tools), ultrasonic tools, and various nuclear tools that can monitor, for example, sigma-capture cross section or carbon/oxygen ratios. These analytical tools can image or detect fluid front, measure saturation of fluid(s), and/or otherwise monitor movement of fluid front, which, in turn, can be used to determine wettability. In some embodiments, wettability measurements can be made in real-time, semi real-time, and/or post-treatment (e.g., after a hydraulic fracturing treatment).

Figure 2:
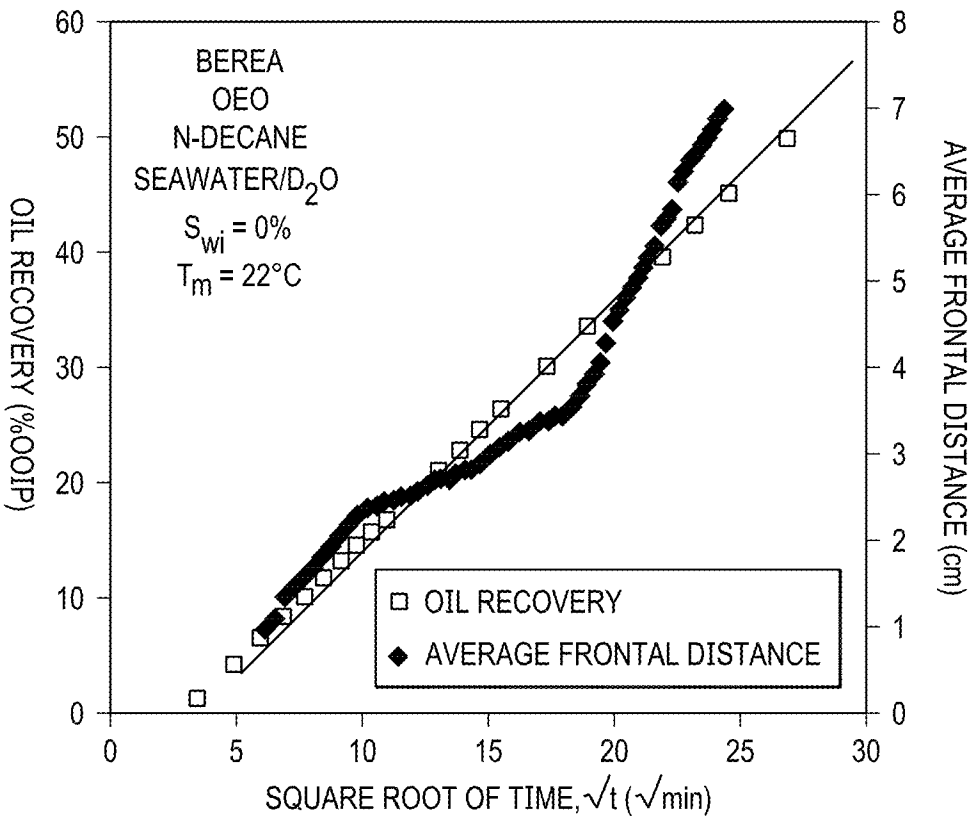
FIG. 2 shows a plot summarizing oil recovery and average frontal distance of water front as a function of square root of time during spontaneous water imbibition of Berea sandstone.

FIG. 1 is a sample series of MRI images showing water (dark) displacing oil (light) in core samples. The movement of water and oil is evident as shown in time-lapse images taken at 38 minutes, 43 minutes, 48 minutes, 65 minutes, 84 minutes, 118 minutes, and 164 minutes during water injection at very low rates. Moreover, time-elapsed images show that imbibition in this experiment resolved into a sharp piston-like (frontal) displacement. In some cases, imbibition may be characterized by more diffuse fronts where the injected fluid displaces the in-situ reservoir fluid. These MRI images provide additional information on the movement of the water imbibition front that matches conventional production curve (FIG. 2). An adequate number of scans may need to be performed in order to obtain a good quality image.

Imbibition rates can be determined directly from the images by measuring movement of the front. Wettability may be qualitatively assessed (e.g. more water-wet, mixed-wet or more oil-wet) based on the imbibition rate in comparison to a model rock type. In other words, slope of the imbibition rate curve can be compared to imbibition rates of a model rock (e.g., Berea sandstone for a sandstone reservoir or an outcrop carbonate for a carbonate reservoir.) Similarly, other imaging techniques that can be used downhole can provide imbibition rates. During imbibition, the injectant fluid will generally take the path of least resistance (e.g., along permeable beds constrained by impermeable beds) and also depend on the type of injection. In some cases, the injectant fluid can flow radially or start in a single direction and slowly spread out.

FIG. 2 is a sample plot that illustrates the relationship between oil recovery and front movement during a water imbibition study performed on an one-end open (OEO) Berea sandstone core. Both oil recovery (%) and average frontal distance (cm) as measured from time-lapse images were graphed against square root of time (√mins). As shown in this plot, oil recovery and average frontal distance exhibits a linear relationship with respect to square root of time.

NMR-active nuclei include, but are not limited to, $^{1}H$, $^{13}C$, $^{17}O$ and the like. NMR relaxation signals observed in NMR-active nuclei can be influenced by the wettability of an environment. More specifically, NMR relaxation properties can be sensitive to the interactions of a fluid with reservoir rock. NMR-active nuclei have angular momentum ("spin") and a magnetic moment that can be aligned with an external magnetic field in an equilibrium state. Wettability of a rock surface can sometimes measurably affect the nuclear relaxation of the water or liquid hydrocarbon that it is in contact with. The rate of relaxation depends on a number of factors including, but not limited to, dipole-dipole interaction between the magnetic moment of a nucleus and the magnetic moment of another nucleus or entity (e.g., electron, atom, ion, molecules), chemical shift anisotropy (CSA) relaxation mechanism, and spin rotation (SR) relaxation mechanism.

A wide range of logging modalities or physical tools may be used to monitor frontal movement. These monitoring tools can be arranged as part of a reservoir wettability logging tool when placed into the reservoir. The reservoir wettability logging tool may also include: wireline for lowering the tools to selected depths, fluid monitoring tool for injecting and monitoring displacement fluid, and/or sealing apparatuses (e.g., packers) for isolating an interval.

In some embodiments, measurement frequency on a spectroscopy analytical tool (e.g., NMR) can be modulated to vary the depth or position of investigation. In the case of NMR, the magnetic field strength decreases away from the tool, which the resonance frequency is a function of. Hence, the measurement frequency can be varied to detect signals at different depths of investigation. In some embodiments, the spectroscopic tool can be placed at various depths or positions and track frontal movement.

Sealing of an interval within the reservoir may be achieved by any suitable downhole sealing devices (e.g., packers). Sealing ensures adequate control of flow rates and pressures during injection of the displacement fluid. In some embodiments, one or more packers may be placed at different depths and/or positions in order to seal off a specified interval. The interval may correspond to a vertical or non-vertical region (e.g., deviated, horizontal, etc.) within the reservoir. In some embodiments, sealing may be reversible, which allows the sealing device to be relocated and subsequently seal a different interval.

In some embodiments, the water injection may be controlled and monitored by an in-situ wettability logging tool. Injection of the displacement fluid into the reservoir may be achieved by any suitable means. In some embodiments, injection of the displacement fluid can be controlled by a pump (e.g., hydraulic, pneumatic, etc.) to maintain suitable rates and pressure gradients as desired. In some embodiments, a standard pressure-testing tool for downhole measurements may be used. The rate of injection and pressure gradient should fall within ranges such that reservoir fluids mimic spontaneous imbibition behavior. In some embodiments, the rate of injection is held at constant flow rates, injection rates, and/or injection pressures. In some embodiments, the rate of displacement fluid injection may range from about 0.001 m/day to about 10 m/day. In some embodiments, the pressure gradient of the displacement fluid may range from several psi's above the reservoir fluid pressures to several 10s of psi above the reservoir fluid pressures. The exact rate of injection, pressure gradient, and/or displacement fluid flow rate may depend on a number of factors including, but not limited to, viscosity of the displacement fluid, type of reservoir rock, permeability. In some embodiment, the displacement fluid is injected at a flow rate ranging from about 0.1 $cm^3$/min to about 100 $cm^3$/min. The exact flow rate may also depend on a number of factors including, but not limited to, total volume of the tested interval, thickness of the interval, and the like.

Figure 3:
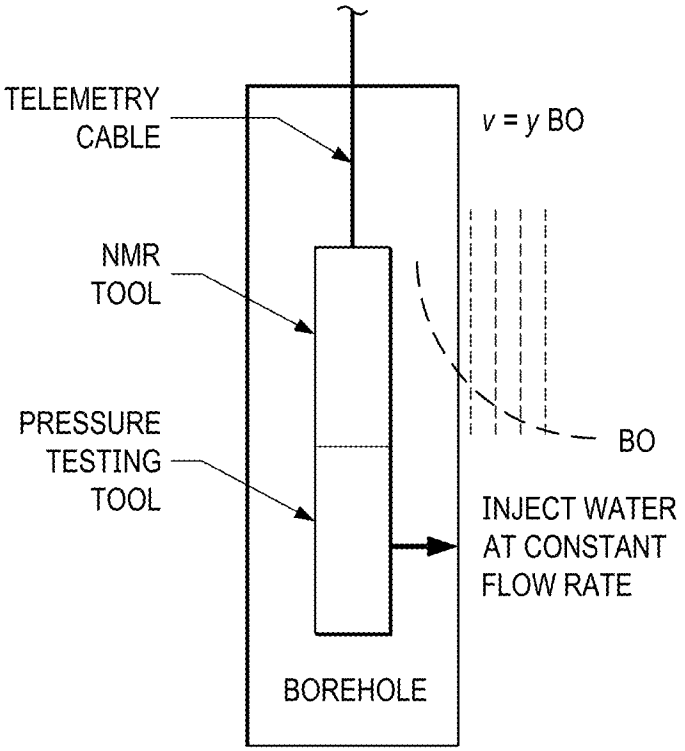
FIG. 3 illustrates a reservoir wettability logging tool according to an embodiment lowered into a wellbore.

FIG. 3 illustrates the reservoir wettability logging tool according to one embodiment. As shown in FIG. 3 the reservoir wettability logging tool includes a telemetry cable, an NMR logging tool, and a pressure testing tool. In other embodiments, the reservoir wettability logging tool may further comprise sealers that can seal an interval along the reservoir. A person of ordinary skill in the art will recognize that other analytical tools and sensors such as those described earlier may be used in place of or in addition to the NMR logging tool. Optionally, the pressure testing tool may further comprise of a water injection tool.

In the illustrated embodiment, the NMR logging tool and the pressure testing tool are coupled to the telemetry cable, which allows the user to set the tools at a specified depth. The NMR logging tool may be an NMR instrument that is used in downhole logging applications and used to measure changes in water saturation levels in the reservoir. NMR logging tools can be used to monitor the movement of the water imbibition front through the application of several different data acquisition and analysis sequences.

In some embodiments, the NMR logging tool includes a magnet that applies a magnetic field on the order of about 0.02 Tesla to about 0.05 Tesla. In some embodiments, the NMR logging tool can vary its measurement frequency ranging from about 0.8 MHz to about 2 MHz. Varying the measurement frequency allows the NMR logging tool to vary the depth of investigation without having to change the depth position of the reservoir wettability logging tool.

The telemetry cable is used to lower the reservoir wettability logging tool to a desired depth in the subterranean formation. Once a given interval is sealed, the pressure testing tool can inject water at constant flow rates. In some embodiments, the pressure testing tool can also include a feedback system for modulating flow rates based on measured flow rate. An in-situ wettability study can be performed by monitoring the movement of the imbibition front as water from the borehole region invades the reservoir.

Downhole pressure testing tools can be adapted to supply water at constant or substantially constant rates and/or injection pressures. A number of wireline logging tools or sensors attached to casing can be used to monitor the progress of the water imbibition front into the reservoir.

EXAMPLE

This example illustrates how different reservoir properties can affect imbibition rates. Study was conducted using Whitestone UZ, an oolitic limestone with relatively large variations in core properties within a single core block.

Experiments were performed with the Whitestone UZ for variation of initial water saturation, aging time, crude oil, and displacement temperatures. Cores with initial water and crude oil are usually defined as Mixed-Wet (MXW) cores because adsorption from crude oil is believed to be restricted to those parts of the rock surface overlain by crude oil. Cores without initial water (fully saturated in crude oil) will be referred to as Uniformly-Wet (UW-CO) because the crude oil has access to the entire rock surface.

Synthetic seawater was used as the brine phase for all the experiments. An Alaskan crude oil was used for all of the experiments and two additional Wyoming crude oils, namely, Minnelusa and Cottonwood crude oils, were used to evaluate the effect of crude oil type on oil recovery by imbibition. Crude oils were filtered and vacuumed before using to saturate the cores. All the cores were aged at 75° C. for ten days unless the aging time was deliberately varied. Cores were prepared with zero nominal aging, and three, ten, and 14 days aging to evaluate effects of aging time on oil recovery by imbibition of brine. A displacement temperature of 75° C. was adopted for most experiments, but the comparative tests were also run at ambient temperature (22° C.) and 60° C. to evaluate the effect of temperature on imbibition rate. The oil recovery versus imbibition time was recorded for all of the experiments and was correlated using the Ma et al. (1997) scaling group.

The Ma scaling group shown below has been used to correlate these imbibition results to eliminate variations in core and fluid properties so that the imbibition rate changes influenced by initial water Saturation, aging time, crude oil and experimental/displacement temperature could be investigated.

$$t_{D,Ma} = t\sqrt{\frac{k}{\phi}}\,\frac{\sigma}{\sqrt{\mu_w\mu_o}}\,\frac{1}{L_c^2} \tag{1}$$

Where $t_D$ is the Ma et al. (1997) dimensionless time, t is time, k is permeability, Φ is porosity, σ is interfacial tension, $\mu_w$ is water viscosity, $\mu_o$ is oil viscosity, and $L_c$ is the characteristic length defined below.

Core samples were prepared with no initial water as part of the tests of the variation of initial water saturation experiments. The cores were vacuum saturated with the crude oil and pressurized under 1000 psi. All the other cores were first vacuum saturated in seawater. Cores were immersed in the brine phase and pressurized at 1000 psi for about a day to assure full saturation. The cores were then left for at least ten days to reach ionic equilibrium at ambient conditions. The initial water saturations in the cores were established using a porous plate. Similar initial water saturations were obtained for each experimental set except when initial water saturation was varied purposely. Cores were then vacuum saturated in the appropriate crude oil and aged at 75° C. for ten days. The weight measurements were taken from the fully saturated cores for the porosity calculations and also for the mass balance calculations. Cores were finally placed in glass imbibition cells and filled with the brine phase. Oil recovery versus time was recorded until the oil recovery was either extremely slow or had ceased.

Figure 4A:
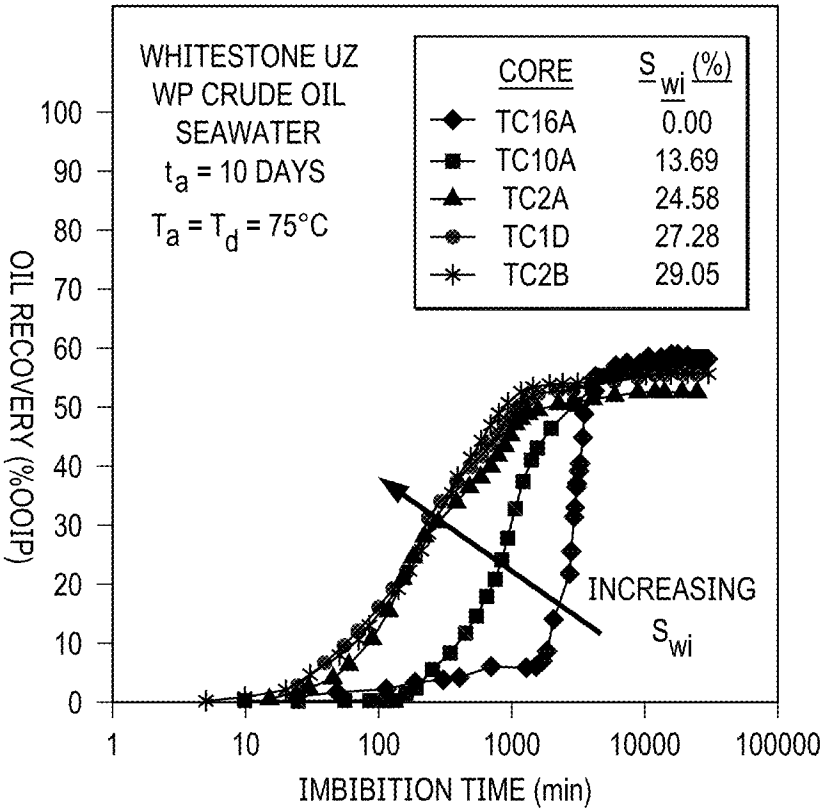
FIGS. 4A-4B illustrate the effect of initial water saturation on oil recovery by spontaneous imbibition for Whitestone UZ limestone.
Figure 4B:
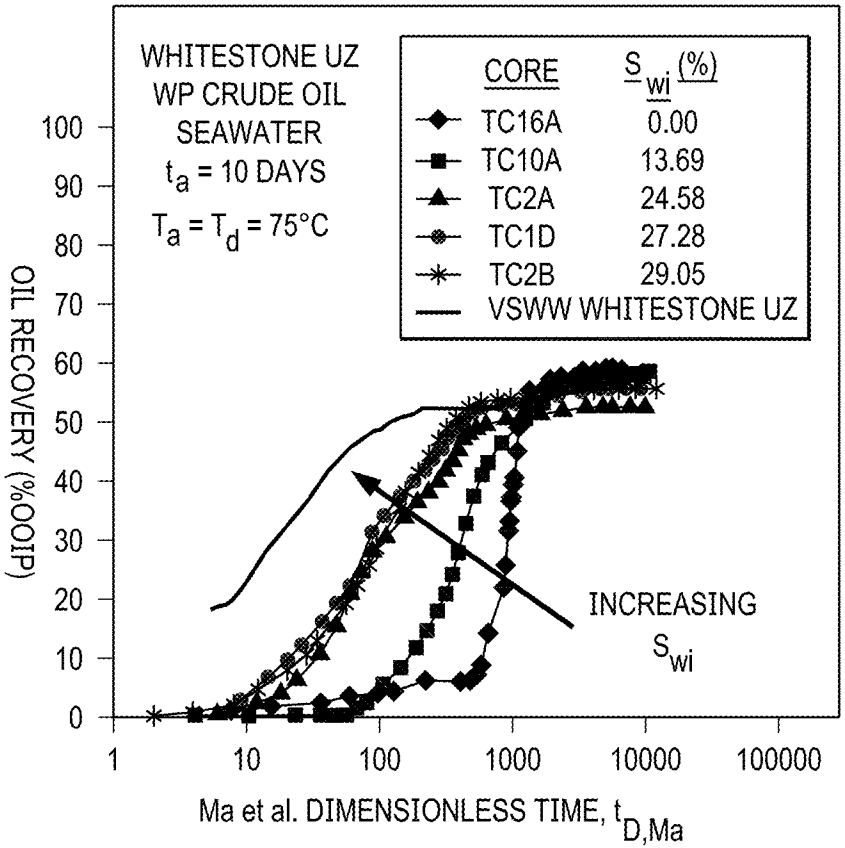

FIGS. 4A-4B illustrate the effect of initial water saturation on oil recovery by spontaneous imbibition for Whitestone UZ limestone. FIG. 4A shows a plot of oil recovery versus imbibition time in accordance with one or more embodiments. FIG. 4B shows a plot of oil recovery versus dimensionless time in accordance with one or more embodiments. These figures illustrate the effect of crude oil type on imbibition oil recovery.

Figure 5A:
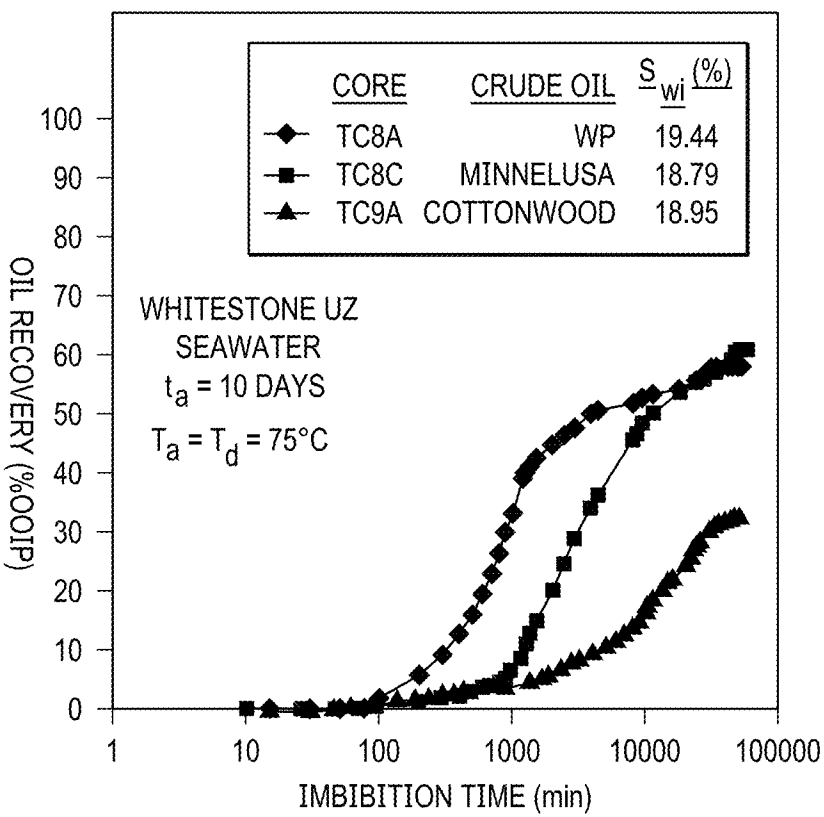
FIGS. 5A-5B illustrate the effect of crude oil on oil recovery by spontaneous imbibition for Whitestone UZ limestone.
Figure 5B:
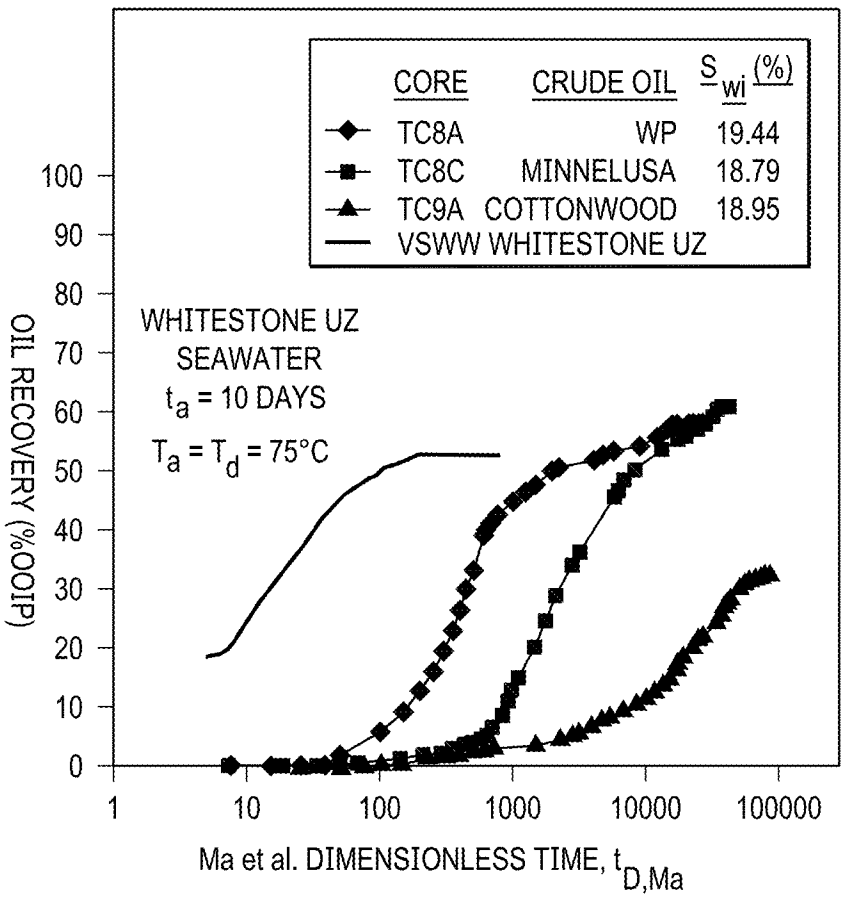

The three tested crude oils exhibited large differences in rate for the same preparation conditions (FIGS. 5A-5B). These figures illustrate the effect of experimental/displacement temperature on imbibition oil recovery. WP crude oil showed the fastest imbibition rate followed by Minnelusa crude oil and Cottonwood crude oil. WP crude oil and Minnelusa crude oil showed similar final oil recoveries with only about 3% Original Oil In Place (OOIP) difference, but Cottonwood crude oil showed a lower final oil recovery even after very long imbibition time. The final oil recovery of Cottonwood crude oil was about half of that observed for WP and Minnelusa crude oils.

Figure 6A:
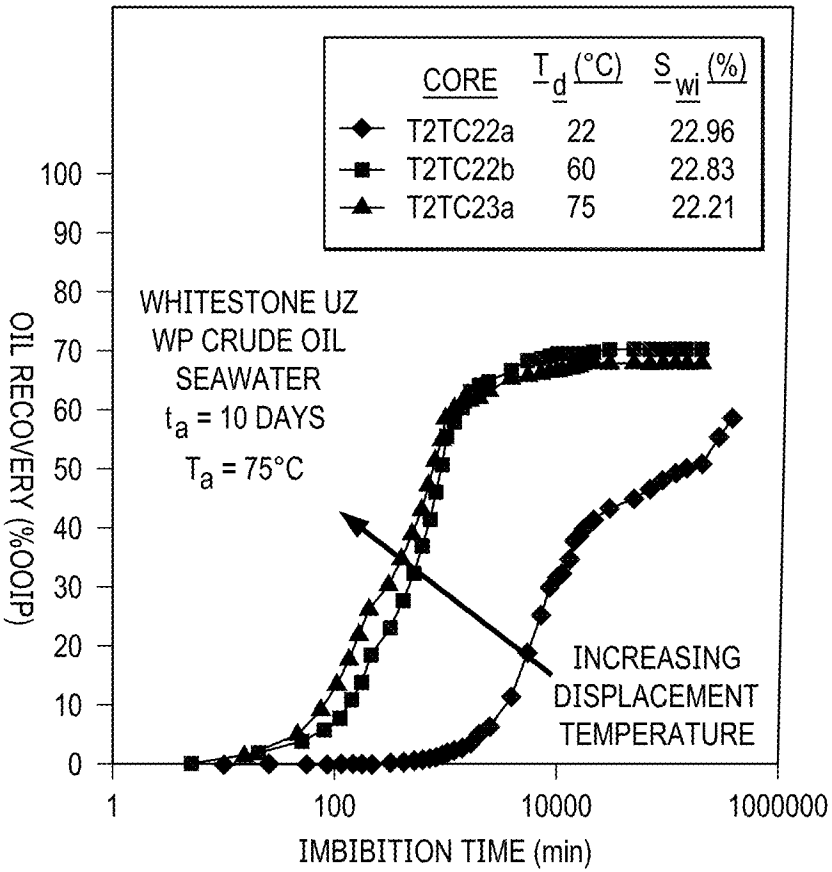
FIGS. 6A-6B illustrate the effect of displacement temperature on oil recovery by spontaneous imbibition for Whitestone UZ limestone.
Figure 6B:
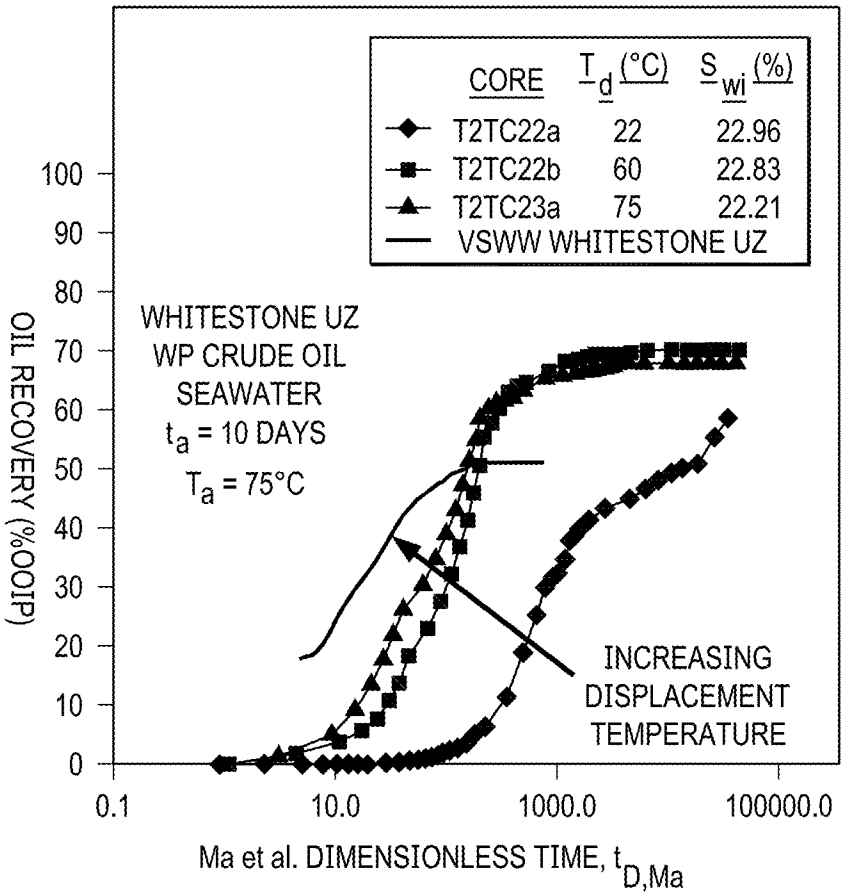

An increase in displacement temperature from ambient (22° C.) to 60° C. increased the imbibition rate by close to two orders of magnitude, but increase in temperature to 75° C. showed only small increase in rate and slightly less recovery compared to the imbibition at 60° C. (see FIGS. 6A-6B).

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication date after the priority date of this application. Incorporated references are listed again here for convenience:

1) U.S. Pat. No. 8,362,767

The invention claimed is:

1. A method for in-situ characterization of a wettability of a reservoir rock in a subterranean formation, comprising:

(a) sealing an interval corresponding to a selected depth or depths within a reservoir rock in a subterranean formation;

(b) injecting a displacement fluid into the interval, wherein the displacement fluid displaces a reservoir fluid stored in the reservoir rock via imbibition;

(c) measuring a rate of a front of said displacement fluid or said reservoir fluid movement in the reservoir rock via a nuclear magnetic resonance (NMR) logging tool to obtain an imbibition rate; and (d) assessing real-time wettability of the reservoir rock based on the imbibition rate measured in step (c).

2. The method of claim 1, wherein the reservoir fluid is selected from the group consisting of: oil, natural gas, hydrocarbon, and any combination thereof.

3. The method of claim 1, wherein the displacement fluid is injected at a flow rate ranging from about 0.1 $cm^3$/min to about 100 $cm^3$/min.

4. The method of claim 1, wherein the displacement fluid is injected at or about a constant injection rate.

5. The method of claim 1, wherein the displacement fluid is selected from the group consisting of: water, brine, aqueous solution, produced water, deuterated water, and any combination thereof.

6. A method for in-situ characterization of a wettability of a reservoir rock in a subterranean formation comprising:

(a) placing a reservoir wettability logging tool comprising a fluid injection tool and an NMR logging tool in a reservoir rock in a subterranean formation at a selected depth or position;

(b) sealing an interval corresponding to the selected depth or position with one or more sealers;

(c) injecting a displacement fluid into the interval at a selected flow rate via the fluid injection tool wherein the displacement fluid displaces a reservoir fluid via imbibition at a displacement temperature;

(d) monitoring a rate of a front of said displacement fluid or said reservoir fluid movement via the NMR logging tool;

(e) assessing real-time wettability of the reservoir rock based on (d);

(el) repeating steps (c) to (e) at various displacement temperatures; and (f) determining an effect of the displacement temperature on said rate.

7. The method of claim 6, wherein the displacement fluid is selected from the group consisting of: water, brine, aqueous solution, produced water, deuterated water, and any combination thereof.

8. The method of claim 6, wherein the displaced reservoir fluid is selected from the group consisting of: oil, natural gas, hydrocarbon, and any combination thereof.

9. The method of claim 6, further comprising: placing the reservoir wettability logging tool at another selected depth and repeating steps (b)-(d).

10. The method of claim 6, wherein the displacement fluid is injected at or about a constant injection rate.

11. The method of claim 6, wherein the NMR logging tool applies an external magnetic field ranging from about 0.02 Tesla to about 0.05 Tesla.

12. The method of claim 6, wherein the NMR logging tool measures frequencies from about 0.8 MHz to about 2 MHz.

13. A method of characterizing a wettability of a subterranean formation, comprising:

(a) placing a reservoir wettability logging tool comprising a fluid injection tool and an NMR logging tool in a subterranean formation at a first depth;

(b) sealing an interval corresponding to the first depth with one or more packers;

(c) injecting a displacement fluid into the interval at a selected flow rate via the fluid injection tool wherein the displacement fluid displaces a reservoir fluid via imbibition;

(d) tracking a rate of a front of the displacement fluid or the reservoir fluid movement via the NMR logging tool to obtain a rate of imbibition; and (e) determining a real-time reservoir wettability of the subterranean formation based on the rate of imbibition obtained in step d).

14. The method of claim 13, wherein the displacement fluid is selected from the group consisting of: water, brine, aqueous solution, produced water, deuterated water, and any combination thereof.

15. The method of claim 13, wherein the NMR logging tool applies an external magnetic field ranging from about 0.02 Tesla to about 0.05 Tesla.

16. The method of claim 13, wherein the NMR tool measures frequencies from about 0.8 MHz to about 2 MHz.

17. The method of claim 13, wherein the displacement fluid is injected at or about a constant injection rate.

18. The method of claim 13, wherein the displacement fluid is injected at a flow rate between about 0.1 $cm^3$/min to about 100 $cm^3$/min.

19. The method of claim 13, wherein the displaced reservoir fluid is selected from the group consisting of: oil, natural gas, hydrocarbon, and any combination thereof.

20. A method for in-situ characterization of wettability of a reservoir rock in a subterranean formation, comprising:

(a) sealing an interval corresponding to a selected depth or depths within a reservoir rock in a subterranean formation;

(b) injecting a displacement fluid into the interval, wherein the displacement fluid displaces a reservoir fluid stored in the reservoir rock via imbibition;

(c) deploying an NMR logging tool in said interval to generate NMR images and measuring a rate of displacement or recovery of a front of said displacement fluid or said reservoir fluid from said NMR images;

(d) assessing real-time wettability of the reservoir rock based on said rate measured in step (c).

* * * * *